US006843005B2

(12) United States Patent
Clapper

(10) Patent No.: US 6,843,005 B2
(45) Date of Patent: Jan. 18, 2005

(54) GRAPPLING ATTACHMENT FOR EXCAVATING MACHINES AND THE LIKE

(75) Inventor: John Clapper, Bedford, PA (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 10/293,288

(22) Filed: Nov. 14, 2002

(65) Prior Publication Data

US 2004/0093770 A1 May 20, 2004

(51) Int. Cl.[7] ..... E02F 9/24
(52) U.S. Cl. ..... 37/406
(58) Field of Search ..... 37/403, 406, 903, 37/966, DIG. 12, 468; 414/704, 722, 724, 740, 723

(56) References Cited

U.S. PATENT DOCUMENTS 5,152,351 A * 10/1992 Rieger ..... 172/813
5,292,079 A * 3/1994 Zakohji ..... 241/264
5,386,652 A * 2/1995 Ramun ..... 37/406
6,209,237 B1 * 4/2001 Heiple et al. ..... 37/406
6,357,993 B1 * 3/2002 Burton ..... 414/724

* cited by examiner

*Primary Examiner*—Robert E. Pezzuto
(74) *Attorney, Agent, or Firm*—Stevens, Davis, Miller & Mosher, LLP

(57) ABSTRACT

A guard member for a fluid actuated rod and cylinder assembly of a machine having front end assembly including a dipper stick, a working implement pivotally connected to the dipper stick, an arm member pivotally connected to the dipper stick and cooperable with the implement to grapple articles therebetween and such rod and cylinder assembly for angularly displacing the arm member relative to the dipper stick, generally consisting of an elongated article mountable on the free end of the rod member and projecting along the length thereof when mounted thereon.

20 Claims, 2 Drawing Sheets

GRAPPLING ATTACHMENT FOR EXCAVATING MACHINES AND THE LIKE

This invention relates to an attachment for an excavating machine and the like, and more particularly to such an attachment cooperable with another implement such as a bucket for grappling articles such as tree trunks, branches and the like therebetween. The invention further contemplates such an attachment having means for shielding operative components thereof from the environment in which the attachment is used.

BACKGROUND OF THE INVENTION

Front end assemblies of excavating machines typically include a boom mounted on the main support frame of the machine, a hydraulic cylinder assembly operatively interconnecting the frame and the boom for raising and lowering the boom, a dipper stick pivotally connected to the free end of the boom, a hydraulic cylinder assembly interconnecting the boom and the dipper stick for pivoting the dipper stick relative to the boom, a bucket pivotally connected to the free end of the dipper stick and a hydraulic cylinder assembly operatively interconnecting the dipper stick and the bucket for curling and uncurling the bucket. For use in such assemblies in grappling various articles such as tree trunks, branches and brush, there has been developed an arm member, commonly referred to as a "thumb" which is adapted to cooperate with the bucket of such assembly for grappling articles therebetween. Generally, such thumbs have been connected to the underside of the dipper stick and have been provided with either a rigid strut interconnecting the dipper stick and the thumb to provide a thumb disposed at a fixed angle relative to the dipper stick or a hydraulic cylinder operatively interconnecting the dipper stick and thumb to permit the angle of the thumb relative to the dipper stick to be varied.

In the use of the later type of thumb assembly, it has been found that the location of the cylinder assembly below the dipper stick and adjacent the work area of the thumb member and the excavator bucket or other implement of the machine, often results in accidental damage to the rod member of the cylinder assembly and/or impairment of the seal between the rod and the cylinder members of the assembly. It thus is the principal object of the present invention to provide a thumb assembly for an excavating machine and the like, utilizing a hydraulic cylinder assembly for positioning the thumb member thereof, in which such cylinder assembly is protected from accidental damage of the rod member thereof and impairment of the seal between the rod and cylinder members thereof.

SUMMARY OF THE INVENTION

The present invention relates to a machine having a front end assembly including a dipper stick, a working implement pivotally connected to the dipper stick and an arm member commonly referred to as a thumb, pivotally connected to the dipper stick and cooperable with such implement to grapple articles therebetween, and provides for an assembly for angularly displacing the arm member relative to the dipper stick generally consisting of a fluid actuated cylinder assembly including a base member pivotally connectable to one of the dipper and the arm member and a rod member pivotally connectable to the other of the dipper stick and the arm member, and a guard member mounted on the free end of the rod member and extending along the length thereof. Preferably, the guard member has a substantially cylindrical configuration, a radius slightly larger than the cylinder member of the assembly and a length greater than the extended length of the rod member so that the guard member is telescopically disposed relative to cylinder member of the rod and cylinder assembly.

DETAILED DESCRIPTION OF THE EMBODIMENT OF THE INVENTION

Figure 1:
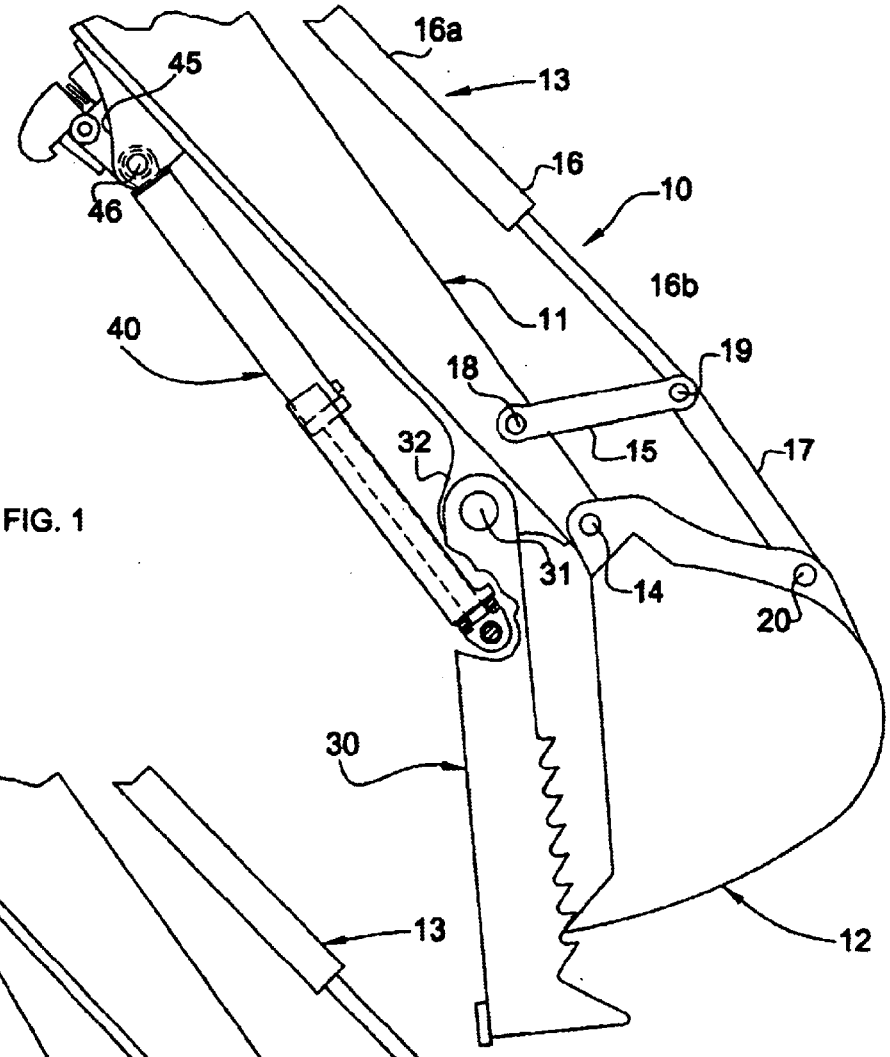
FIG. 1 is a side elevational view of the front end assembly of an excavating machine, utilizing an assembly embodying the present invention, illustrating the assembly in extended condition and having a portion thereof broken away.
Figure 2:
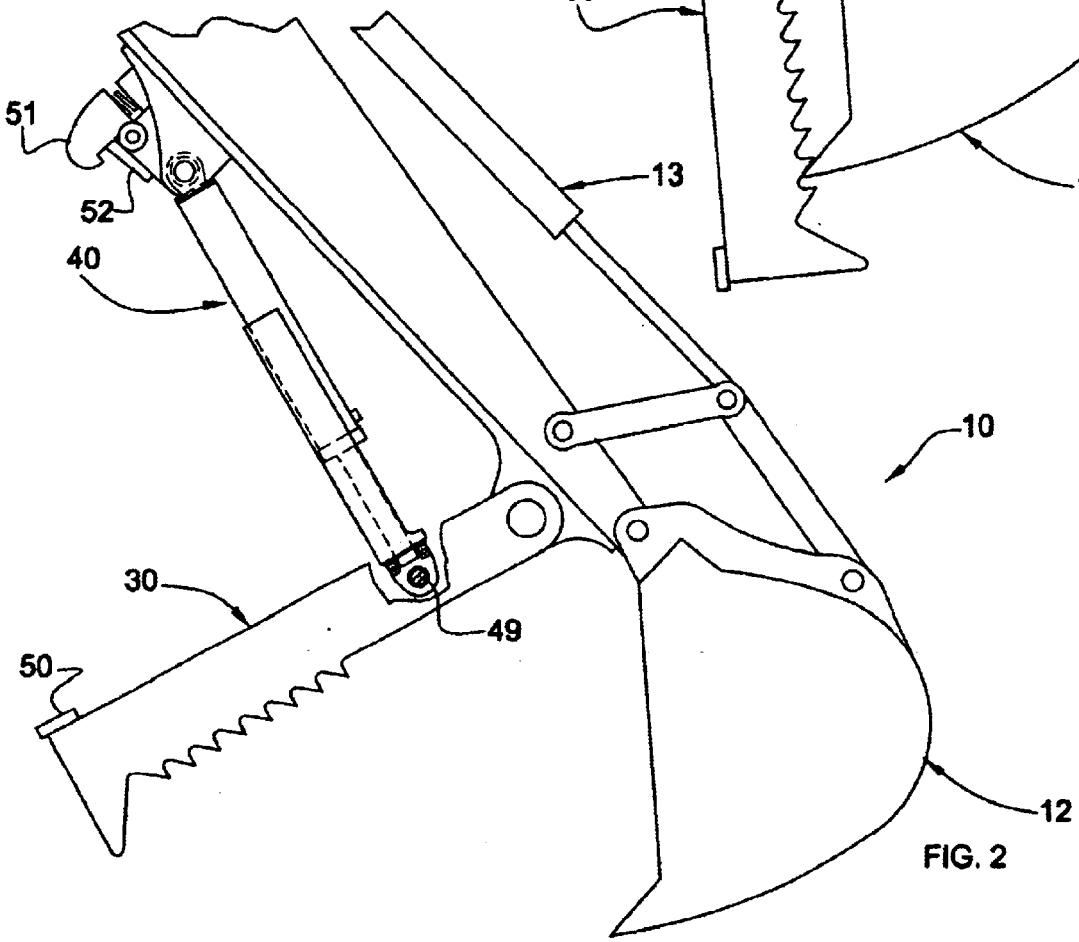
FIG. 2 is a view similar to the view shown in FIG. 1, illustrating the assembly embodying the invention in a retracted condition.

Referring to FIGS. 1 and 2 of the drawings, there is illustrated a front end assembly 10 of an excavating machine which generally includes a dipper stick 11, a bucket 12 and a tilting assembly 13. Dipper stick 11 is pivotally connected at an upper end thereof to the free end of the boom connected to the main support frame of the machine, and is adapted to be raised and lowered by means of a hydraulic cylinder assembly operatively interconnecting the boom and the dipper stick. Bucket 12 is pivotally connected to the free end of the dipper stick by means of a connecting pin 14. Assembly 13 is operable to curl and uncurl bucket 12 about the axis of connecting pin 14 and includes a pair of support links 15,15, a hydraulic cylinder assembly 16 and a tilt link 17. Support links 15,15 are pivotally connected to the side walls of the dipper stick by means of a connecting pin 18 and are connected together at the opposite ends thereof by means of a connecting pin 19. Tilt link 17 is pivotally connected at one end to connecting pin 19 and pivotally connected at the other end thereof to bucket 12 by means of a connecting pin 20. Cylinder assembly 16 includes a cylinder member 16*a* pivotally connected at a base end thereof to a bracket mounted on an upper side dipper stick 11, and a rod member 16*b* pivotally connected to connecting pin 19.

An arm member 30 is pivotally connected by means of a connecting pin 31 to a bracket 32 mounted on the underside of the dipper stick adjacent the free end thereof. The axes of connecting pins 14 and 31 are disposed parallel and adjacent each other so that the bucket and arm member may be substantially angularly displaced toward and away from each other to perform various work functions. Arm member 30 may be fully retracted against the underside of the dipper stick to permit the bucket to be curled and uncurled in the conventional manner to provide excavating functions, and may be extended at a selected angle relative to the dipper stick to cooperate with the bucket to grapple various forms of articles therebetween such as tree trunks, branches, brush and the like. The arm member may be formed with a length greater than the dimension of the opening of the bucket and with a set of teeth to firmly engage objects between the arm member and the bucket.

The arm member may be angularly displaced relative to the dipper about the axis of connecting pin 31 by an actuating assembly 40. As best seen in FIGS. 3 through 6, such assembly includes a fluid actuated cylinder assembly 41 operatively interconnecting the underside of the dipper stick and arm member 30, and a guard or shield member 42. Assembly 41 includes a cylinder member 43 having a fixture 44 at the base end thereof pivotally connected to bracket 45 mounted on the underside of the dipper stick, spaced from bracket 32, by means of a connecting pin 46, and a rod member 47 having a fixture 48 pivotally connected to arm member 30 by means of a connecting pin 49. It will be appreciated that by extending and retracting rod member 47 the arm member may be angularly displaced about the axis of connecting pin 31, and may be locked in selected positions to fix the angle of the arm member relative to the dipper stick. The arm member may be moved to and maintained in its fully retracted position against the underside of the dipper stick to allow the bucket to pivot and work independently by fully retracting rod member 47 to cause a trip plate 50 disposed on the lower rear side of the arm member to trip a spring biased catch 51 and engage a plate 52 provided on the dipper stick adjacent to bracket 45. Means are provided on the dipper stick for pivoting catch 51 to allow the arm member to be released from its fully retracted, inoperative position to a selected, extended operative position as shown in FIG. 1.

Figure 3:
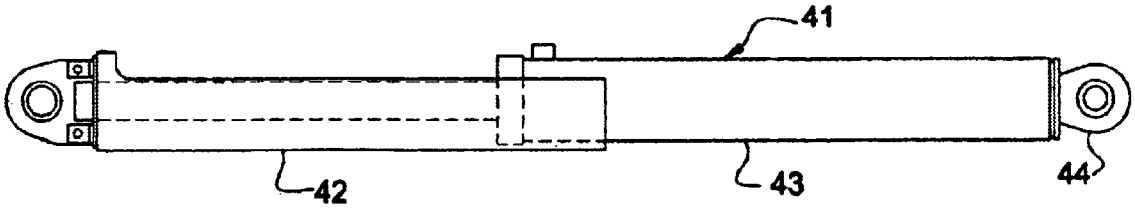
FIG. 3 is a side elevational view of the assembly embodying the present invention, shown in FIGS. 1 and 2.
Figure 4:
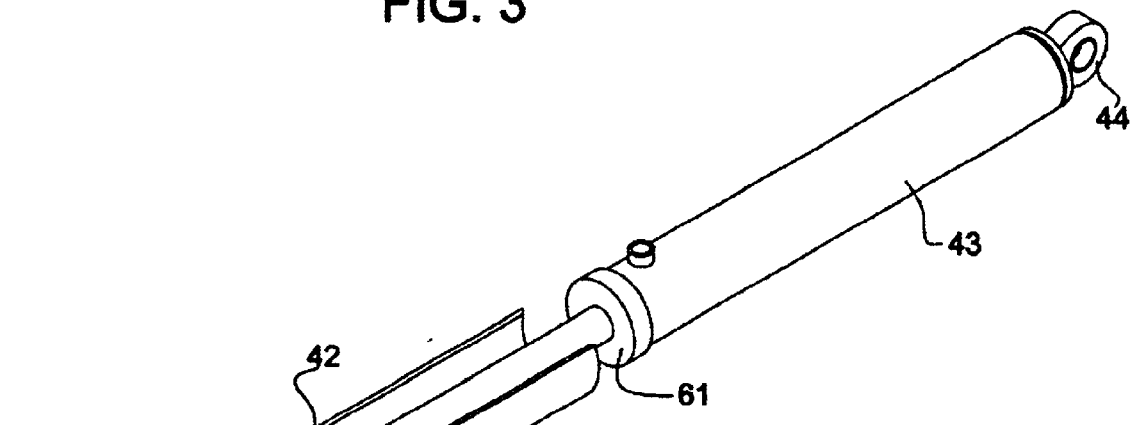
FIG. 4 is a perspective view of the assembly shown in FIG. 3, illustrating the components thereof in exploded relation.
Figure 5:
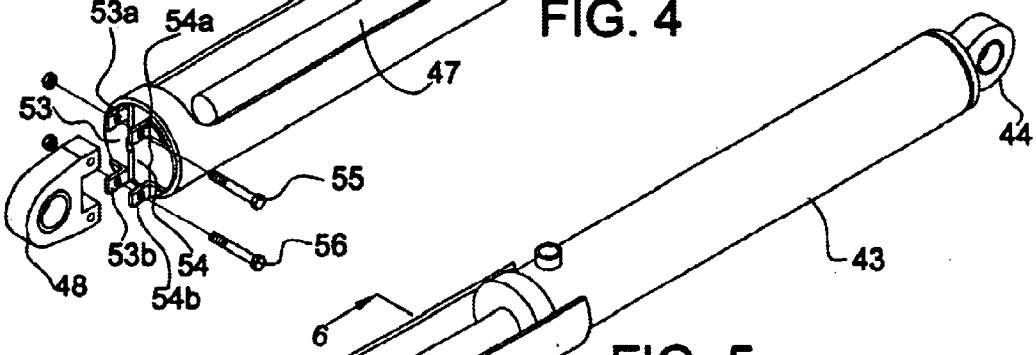
FIG. 5 is a perspective view of the assembly shown in FIG. 3, illustrating the assembly in an extended condition.
Figure 5A:
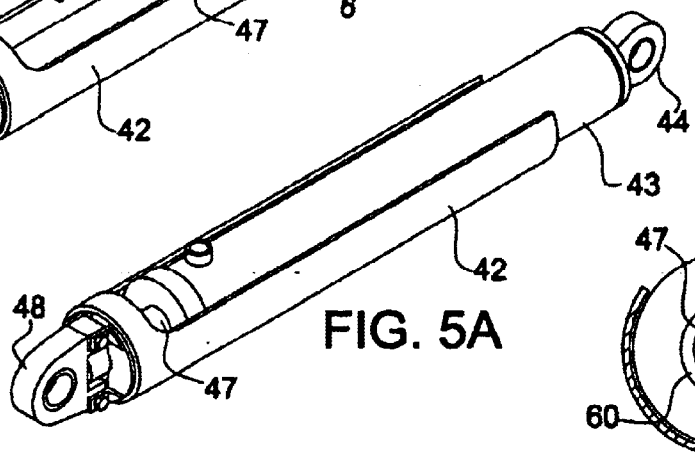
FIG. 5A is a perspective view of the assembly shown in FIG. 5 illustrated in a retracted condition.

Guard member 42 is substantially cylindrical in configuration, having an inside diameter slightly greater than the diameter of cylinder member 43 and a length slightly shorter than the length of cylinder member 43. It is disposed coaxially with rod member 47 and is rigidly connected at a forwardly disposed end thereof to bracket 48. As best shown in FIGS. 3 and 4, the forwardly disposed end of member 42 is provided with a pair of inwardly projecting portions 53 and 54 having forwardly projecting tab segments 53*a* and 53*b* and 54*a* and 54*b* which engage side surfaces of fixture 48 and are secured thereto by means of sets 55 and 56 of bolts and nuts. The rear end of the guard member is open so that the guard member may be disposed telescopically with cylinder member 43 when rod member 47 is extended and retracted as shown in FIGS. 5 and 5A, and the upper side thereof is slotted as at 57 so as to avoid interference with any fluid line connections of the cylinder member.

Figure 6:
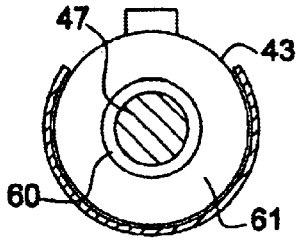
FIG. 6 is an enlarged, cross sectional taken along line 6—6 in FIG. 5.

In the use of actuating assembly 40, rod member 47 may be fully retracted to position the arm member against the underside of the dipper stick and maintained there by catch 51 to permit the bucket to be curled and uncurled in the conventional manner to perform digging operations. When it is desired to employ the arm member to cooperate with the bucket to grapple various objects, catch member 51 may be tripped to release the arm member, and the arm member may be pivoted to a desired position as shown in FIG. 1 by operating certain controls at the operator's station on the machine and thus supply fluid under pressure to the base end of cylinder member 43. Once the arm member is in the desired position, the cylinder of assembly 40 may be locked to fix the position of the arm member. The cylinder assemblies of the boom, dipper stick and bucket may then be operated to maneuver the arm member and the bucket relative to the arm member to grapple, displace and release various articles such as tree trunks, branches and brush. As the machine is operated in such a mode, exposure of rod member 17 to various objects tending to bend or otherwise damage the rod member is prevented by guard member 42. Furthermore, foreign, perhaps abrasive material, is prevented from lodging on rod member 47 and being drawn between the rod member and seal 60 provided between the rod member and the front wall 61 of cylinder member 43, as shown in FIG. 6, also by guide member 42.

Guard member 42 may be formed of any suitable cylindrical stock material although it is preferred that it be formed of steel or perhaps a lightweight metal such as aluminum. It may be formed and installed simply by the selection of the suitable size of tubular material, forming the slot in the upper side thereof, forming the tab segments on the forward end thereof, sliding the member on the rod member and then securing the tab segments to fixture 48 to position the guard member coaxially with the rod member, and rigidly securing the forwardly disposed end thereof to fixture 48 of the rod member. With the guard member of the proper size and aligned with cylinder member 43, it will be telescopically disposed relative to cylinder assembly 43 as rod member 47 is extended and retracted as shown in FIGS. 5 and 5A.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. In a machine having a front end assembly including a dipper stick, a working implement pivotally connected to said dipper stick and an arm member pivotally connected to said dipper stick and cooperable with said implement to grapple articles therebetween, an assembly for angularly displacing said arm member relative to said dipper stick about said pivotal connection therewith, comprising:

a fluid actuated cylinder assembly including a base member pivotally connectable to one of said dipper stick and said arm member and a rod member pivotally connectable to the other of said dipper stick and said arm member; and a guard member mounted on the free end of said rod member and extending along an underside thereof and along the length thereof.

2. An assembly according to claim 1 wherein said guard member has an arcuate cross sectional configuration.

3. An assembly according to claim 2 wherein said arcuate cross section of said guard member exceeds 180°.

4. An assembly according to claim 2 wherein said guard member functions to at least partially encompass said cylinder member when said rod member is retracted.

5. An assembly according to claim 1 wherein said guard member has a cylindrical configuration with a longitudinally disposed slot in an upper side thereof.

6. An assembly according to claim 5 wherein said guard member has a diameter slightly greater than the diameter of said cylinder member to permit said guard member and said cylinder member to be disposed in telescopic relation upon extension and retraction of said rod member.

7. An assembly according to claim 1 wherein said guard member is supported on a fixture disposed on the free end of said rod member, which is pivotally connectable to said arm member.

8. An assembly according to claim 7 wherein said guard member is formed of tubular metal stock.

9. An assembly according to claim 7 wherein said guard member is provided with a set of tabs attachable to said fixture.

10. An assembly according to claim 1 wherein said guard member has a length greater than the maximum extended length of said rod member.

11. A guard member for a fluid actuated rod and cylinder assembly of a machine having a front end assembly including a dipper stick, a working implement pivotally connected to said dipper stick, an arm member pivotally connected to said dipper stick and cooperable with said implement to grapple articles therebetween and a rod and cylinder assembly operatively interconnecting said dipper stick and said arm member for angularly displacing said arm member relative to said dipper stick, comprising an elongated article mountable on the free end of said rod member, projecting along the length thereof and along an underside thereof when mounted thereon.

12. A member according to claim 11 wherein said article has an arcuate cross sectional configuration.

13. A member according to claim 12 wherein said arcuate cross section of said article exceeds 180° and encompasses a portion of said rod member when mounted thereon.

14. A member according to claim 12 wherein said article functions to at least partially encompass said cylinder member when mounted on said rod member and said rod member and said rod member is retracted.

15. A member according to claim 11 wherein said article has a cylindrical configuration with a longitudinally disposed slot in an upper side thereof.

16. A member according to claim 15 wherein said article has a diameter slightly greater than the diameter of said cylinder member to permit said article to be disposed in telescopic relation with said cylinder member when said article is mounted on said rod member and said rod member is extended and retracted.

17. A member according to claim 11 wherein said article is mountable on a fixture disposed on the free end of said rod member.

18. A member according to claim 11 wherein said article is formed of tubular metal stock.

19. A member according to claim 17 wherein said article is provided with a set of tabs attachable to said fixture.

20. A member according to claim 11 wherein said article has a length greater than the maximum extended length of said rod member.

* * * * *